United States Patent [19]

Cunningham et al.

[11] Patent Number: 4,790,107

[45] Date of Patent: Dec. 13, 1988

[54] WINDOW SECURING DEVICE

[75] Inventors: Phillip J. Cunningham, Claymont; Leon F. Slocomb, Jr.; George Wilkie, both of Wilmington, all of Del.

[73] Assignee: Slocomb Industries, Inc., Wilmington, Del.

[21] Appl. No.: 921,123

[22] Filed: Oct. 21, 1986

[51] Int. Cl.[4] ..... E06B 7/16

[52] U.S. Cl. ..... 49/383

[58] Field of Search ..... 49/383

[56] References Cited

U.S. PATENT DOCUMENTS 3,063,105 11/1962 Hollands ..... 49/383 X 3,686,795 8/1972 La Barge ..... 49/383 X

FOREIGN PATENT DOCUMENTS 2845938 4/1980 Fed. Rep. of Germany ..... 49/383

*Primary Examiner*—Philip C. Kannan

*Attorney, Agent, or Firm*—Connolly & Hutz

[57] ABSTRACT

A securing device for casement windows or the like includes an abutment member secured to the master frame in the path of motion of an engaging member. The abutment member extends away from the master frame a greater distance at the end of the abutment member nearer to the inner side of the window. The engaging member is mounted to the casement frame and extends away from the casement frame a greater distance at its side closer to the outside of the window. Both the abutment member and engaging member include non-planar contacting surfaces which mate when the window is in its closed position. This arrangement of the abutment member and engaging member also prevents the casement frame from bulging away from the master frame under wind pressure. The securing device is mounted along one side of the window.

9 Claims, 4 Drawing Sheets

WINDOW SECURING DEVICE

BACKGROUND OF THE INVENTION

A popular form of windows is a casement window which includes a master frame fixed to the structure such as a building or house and a casement frame which carries the window. The master frame and casement frame are hinged together by concealed hinges along the top and bottom. One side of the window generally includes a manual lock. During the opening and closing of the window the casement frame moves in an irregular path until it engages the master frame. Various devices have been provided to attempt to seal the casement frame to the master frame in the closed position. Heretofore no satisfactory device has been provided along the side of the casement window opposite its manual lock. Accordingly, under severe wind conditions there frequently results a bulging or bellying-out of the casement frame from the master frame along the unlocked side.

SUMMARY OF INVENTION

An object of this invention is to provide a securing device particularly usable along the unlocked side of the window.

A further object of this invention is to provide such a securing device which may be readily adapted to existing casement windows and which may be easy to manufacture and thereby low in cost.

In accordance with this invention an abutment member is mounted along the unlocked side of the master frame. The abutment member projects outwardly from the master frame a greater distance along its end disposed toward the inside of the window. An engaging member is similarly mounted to the casement frame and extends outwardly from the casement frame a greater distance along its outer end or side. The abutment member is mounted in the path of motion of the engaging member preferably at the center point of the unlocked side. Both the abutment member and locking member include non-planar contacting surfaces which mate when the window is in its closed position. Accordingly, the force of the wind would simply serve to push the abutment member and engaging member into contact with each other and any tendency for bellying-out which might otherwise exist would be prevented.

In one embodiment of this invention, the contacting surface of both members is in the form of a plurality of teeth which are disposed for interlocking with each other. In an alternative embodiment of this invention, the contacting surface is curved in the form of complementary cam surfaces.

THE DRAWINGS

DETAILED DESCRIPTION

Figure 1:
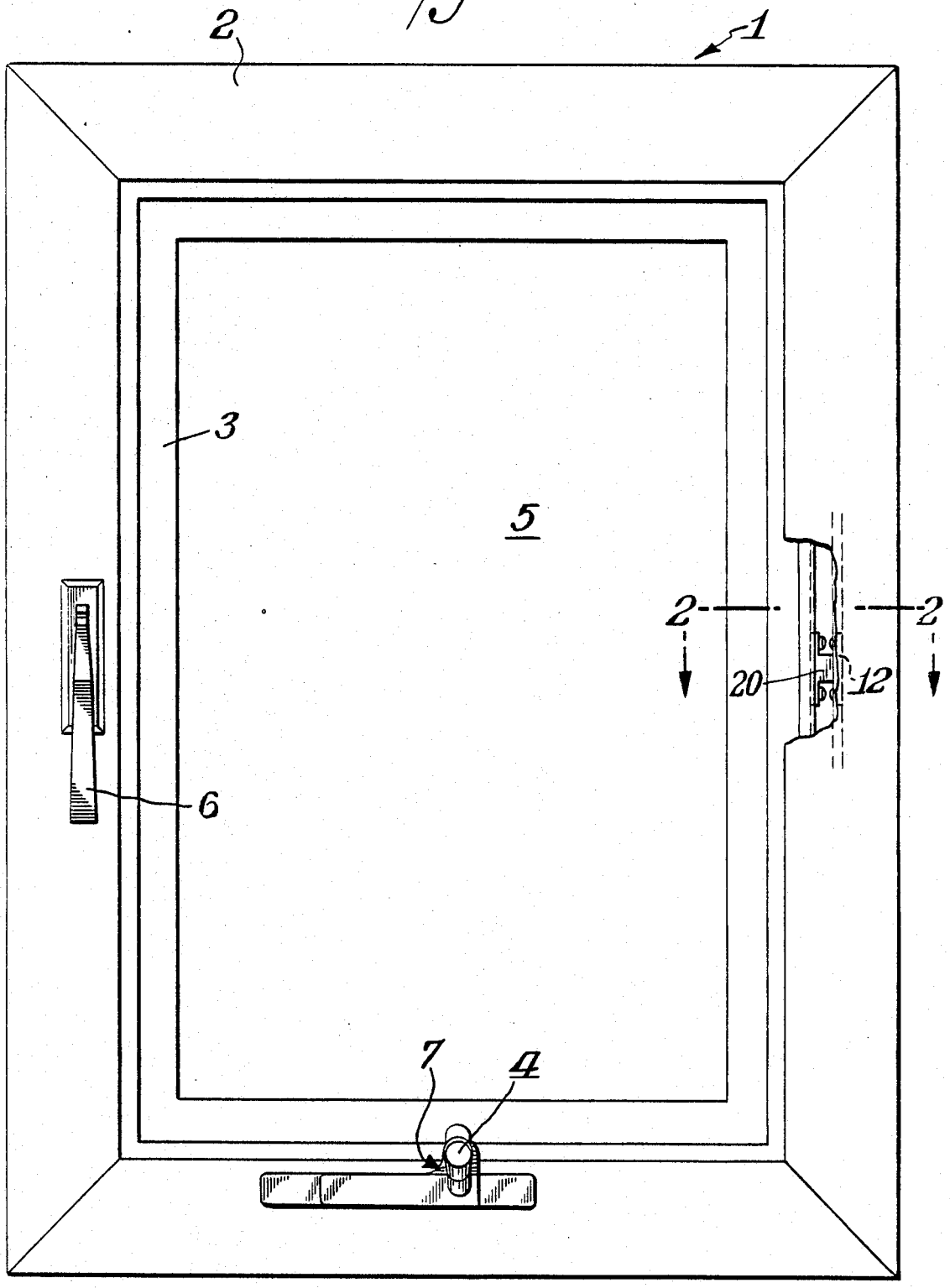
FIG. 1 is a front elevation view partly broken away of a casement window in accordance with this invention.

The present invention is directed to a securing device particularly usable with casement windows or the like. FIG. 1 illustrates a typical casement window 1 which incorporates the securing device of this invention. As shown in FIG. 1, casement window 1 includes a master frame 2 which is preferably made of extruded plastic. Hinged by concealed hinges along the top and bottom thereof is a casement frame 3 which likewise is preferably made of extruded plastic. Such a casement window is generally provided with a handle 4 for actuating hinge means 7 for manipulating the casement frame between its open and closed positions. Thus, when the casement frame is in its closed position, the window pane 5 would close the window. Generally, the casement window would include various locking devices 6 along one side thereof which are intended to seal the window in its closed position. Similarly various sealing means such as gaskets or strips are also provided at portions where the casement frame contacts the master frame.

One of the difficulties with the type of casement window described above is that suitable means are not provided along the unlocked side of the window. Thus, when severe wind conditions exist, there is a tendency of the casement frame to belly-out or bulge away from the master frame. This problem is particularly acute with large windows, five feet or higher. This tendency is particularly troublesome at the center portion of the unlocked side.

The present invention is directed to overcoming the above problems by providing at least one securing device along the unlocked side of the window. If only one securing device is provided, it should be located at about the center point of the unlocked side. Where more than one devices are provided, the locations may be varied as desired.

Figure 2:
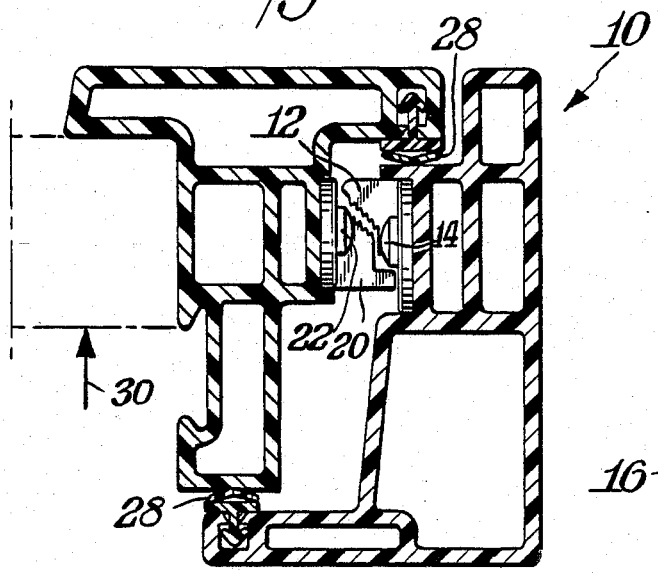
FIG. 2 is a cross-sectional view taken through FIG. 1 along the line 2—2.
Figure 5:
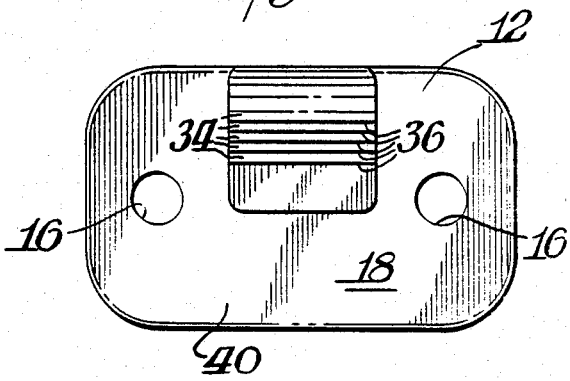
FIG. 5 is a front-elevation view of the abutment member shown in FIGS. 3–4.
Figure 4:
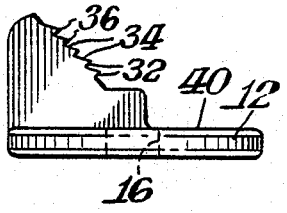
FIG. 4 is a side-elevation view of the abutment member shown in FIG. 3.
Figure 3:
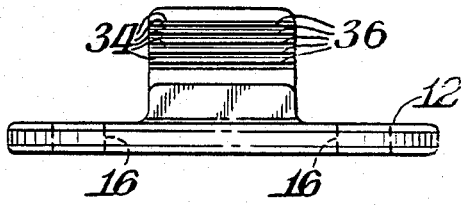
FIG. 3 is a bottom plan view of the abutment member shown in FIG. 2.
Figure 8:
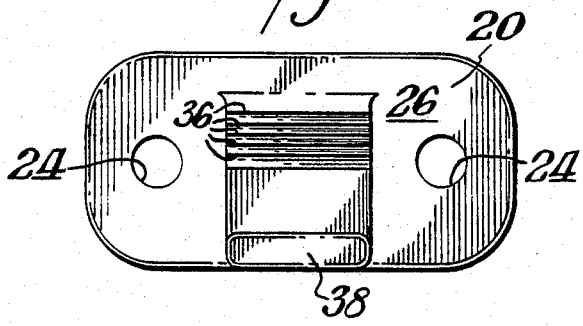
FIG. 8 is a front-elevation view of the engaging member shown in FIGS. 6–7.
Figure 7:
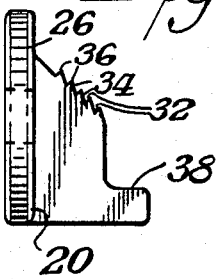
FIG. 7 is a side-elevation view of the engaging member shown in FIG. 6.

FIG. 2 illustrates a securing device 10 in accordance with this invention. In general, the securing device includes an abutment member 12 mounted to the master frame in any suitable manner such as by threaded fasteners 14 extending through holes 16 in the plate portion 18 of abutment member 12.

In accordance with this invention an engaging member 20 is mounted to the casement frame 3 and similarly may be mounted in any suitable manner such as by threaded fasteners 22 extending through holes 24 in the base plate portion 26 of engaging member 20. The relative mounting of the abutment member and engaging member are such that the abutment member extends away from the master frame 2 a greater distance at its outer end which is disposed toward the outer side of the window. Similarly, the engaging member extends away from the casement frame a greater distance at its inner end which is disposed toward the inner side of the window. A contacting surface is provided on each of these members between its respective inner and outer ends.

Figure 17:
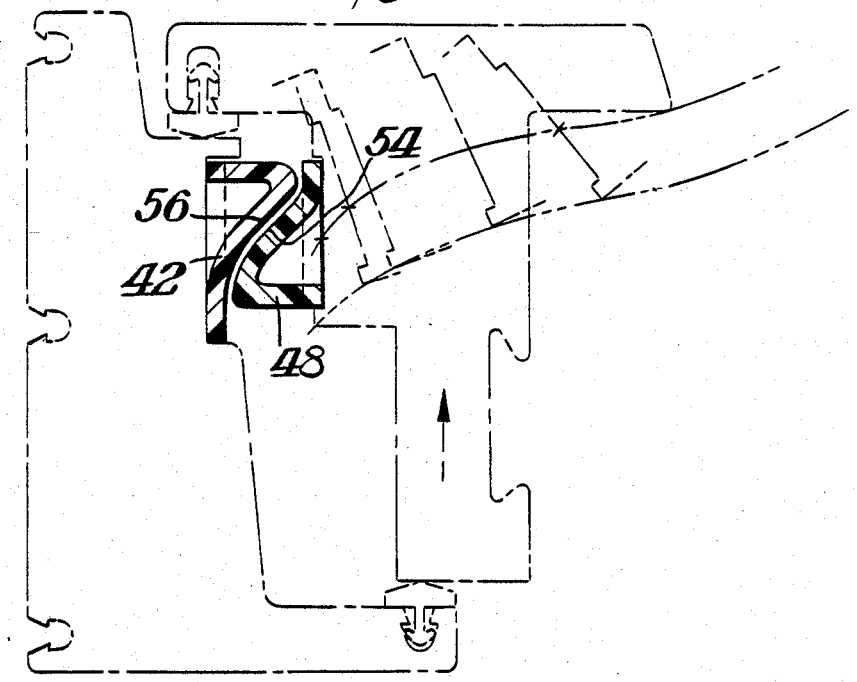
FIG. 17 is a view similar to FIG. 2 showing the abutment member and engaging member of FIGS. 11–16.

FIG. 17 illustrates in phantom the general path taken by the casement frame during its movement between its open and closed positions. As shown therein, when the handle 4 is manipulated with casement frame 3 being in its open position the casement frame is outside the room having the window and is then moved toward the inside along a curved path so that in its closed position sealing contact is made between the casement frame and the master frame. FIG. 2, for example, illustrates various areas of such sealing contact. As indicated therein, sealing members 28 are snapped into suitable openings in both the master frame and the casement frame to provide the intended sealed arrangement. FIG. 2 illustrates by the arrow 30 the direction of internal force resulting from the wind from the outside. Where the wind force is sufficiently high, there is a tendency to press or urge the casement frame tending to result in a bulging or bellying out in a direction away from the master frame. This tendency is resisted at the end of top and bottom by the hinge elements and at one side by the manual lock. Generally, however, where no means are provided along the unlocked side, if the wind force is sufficiently high, there would be a bulging which is particarly acute at the central portion of the unlocked side. The present invention overcomes this tendency by mounting the abutment member in the path of motion of the engaging member so that the contacting surfaces prevent any such bulging.

Figure 9:
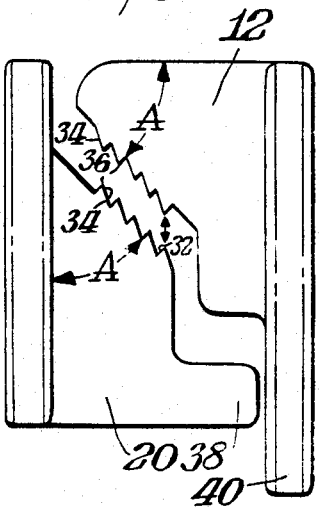
FIG. 9 is a side-elevation view showing the relationship between the abutment member and the engaging member of FIG. 2 in its position prior to the window being closed.
Figure 6:
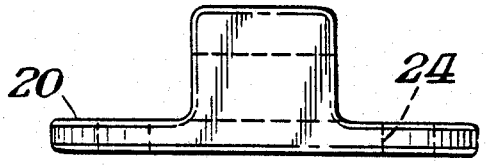
FIG. 6 is a bottom-plan view of the engaging member shown in FIG. 2.
Figure 13:
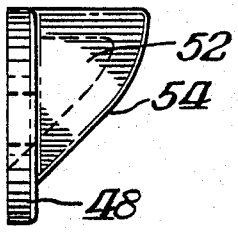
FIG. 13 is a side-elevation view of the engaging member shown in FIGS. 11–12.
Figure 12:
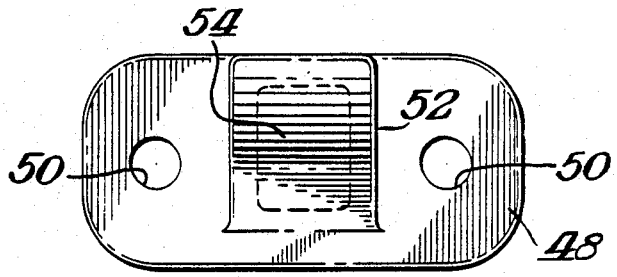
FIG. 12 is a front-elevantion view of the engaging member shown in FIG. 11.
Figure 11:
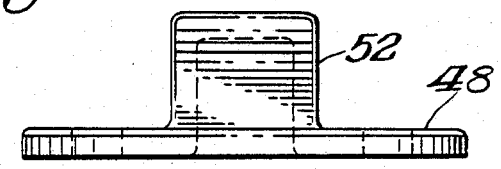
FIG. 11 is a bottom-plan view of an alternative form of engaging member in accordance with this invention.
Figure 16:
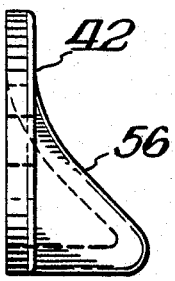
FIG. 16 is a side-elevation view of the abutment member shown in FIGS. 14–15.
Figure 15:
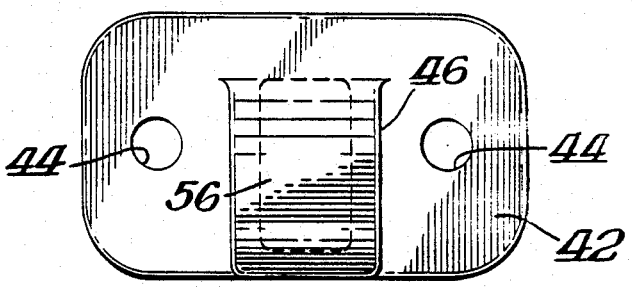
FIG. 15 is a front-elevation view of the abutment member shown in FIG. 14.
Figure 10:
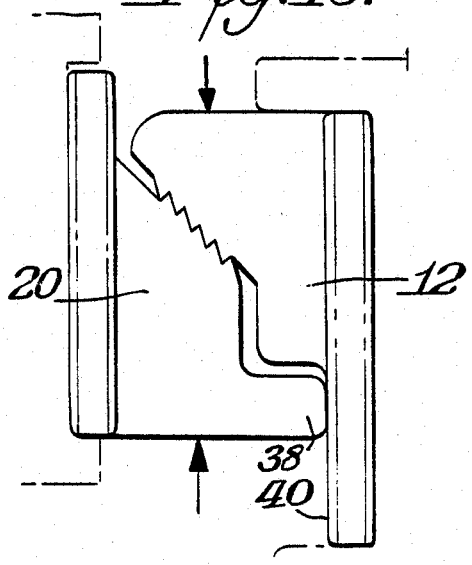
FIG. 10 is a view similar to FIG. 9 in the closed position.
Figure 14:
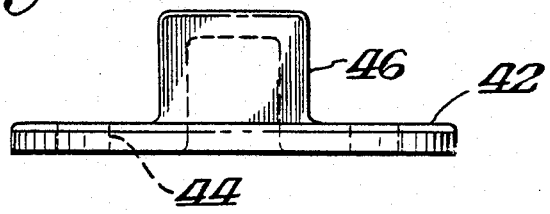
FIG. 14 is a top-plan view of an abutment member usable with the engaging member of FIGS. 11–13.

FIGS. 2–10 illustrate one form of securing device 10 which accomplishes the objects of this invention. As shown therein, the contacting surface of each member is in the form of a plurality of teeth having complementary surfaces so that as shown in FIG. 10 the teeth mate or interlock when the window is in its closed position.

As shown in FIG. 9, each tooth of abutment member 12 may be considered as extending from a base at a steep side 32 and a sloping side 34 which meets at point 36. The line from which the teeth extend which may be considered a base line is at an angle A of preferably 45° to the horizontal. It is to be understood that the angle A may, however, be varied without departing from the invention. In accordance with this invention, the steep side 32 of each tooth is perpendicular to the base line. Engaging member 20 likewise includes a plurality of teeth having steep sides and sloping sides extending from a base line which is perpendicular to the angle A as illustrated in FIG. 9. By this arrangement when engaging member 20 is moved into contact with abutment member 12, the sloping sides 34 of each tooth slide over each other similar to cams until the steep sides 32 contact each other with the point 36 of each tooth being at the base line. The fully engaged position is illustrated in FIG. 10. As also shown therein, engaging member 20 includes a tip 38 which makes contact with extension 40 of the plate portion 18 of abutment member 12. The invention takes into account that with casement windows of the type having concealed hinges, there is a slight lateral shifting of the casement frame before the pivoting or sweeeping motion takes place during the opening of the window. By having the components at 45° and by providing a step construction at the tip 38 and extension 40, the engaged surfaces become disengaged with the lateral shifting and binding is prevented.

FIGS. 11–17 show an alternative form of this invention wherein an abutment member 42 is provided which includes holes 44 for securement to the master frame and which includes a projecting portion 46 generally similar to the projecting portion carrying the teeth of abutment member 12. The difference, however, is that the contacting surface of abutment member 42 does not include teeth but rather is curved in the shape of a cam. If desired, there may be a slight bowing so that essentially line contact is made with the complementary contacting surface of engaging member 48. Engaging member 48 similarly includes holes 50 for securing engaging member 48 to the casement frame and includes a projecting portion 52 having its contacting surface 54 of a curved shape which is complimentary to the contacting surface 56 of abutment member 42. FIG. 17 illustrates the position of abutment member 42 and engaging member 48 as they approach their contacting position when the window is closed.

As can be appreciated, the provision of at least one such securing device along the unlocked side of a casement window thus overcomes the problem of the casement frame bulging under wind conditions.

We claim:

1. In a casement window or the like having a master frame with a casement frame hinged to the master frame, the improvement being a vent securing device for maintaining the window closed along one side thereof when said casement frame is moved to its closed position, said vent securing device comprising an abutment member mounted to said master frame along said one side, said abutment member having a first end and a second end, said first end of said abutment member projecting away from said master frame a distance than said second end, a non-planar contacting surface on said abutment member extending from said first end toward said second end, said vent securing device further including an engaging member mounted to said casement frame along said one side, said abutment member being in the path of motion of said engaging member when said casement frame is moved from its open to its closed positions, said engaging member having a first end disposed toward said first end of said abutment member and a second end disposed toward said second end of said abutment member, said second end of said engaging member projecting away from said casement frame a greater distance than said first end, a non-planar contacting surface on said engaging member extending from said second end toward said first end, said contacting surfaces of said abutment member and said engaging member being complementary to each other, said contacting surfaces mating when said casement frame is in its closed position whereby a force urging said casement frame away from said master frame causes said contacting surfaces to remain in mating contact to prevent said casement frame from being moved away from said main frame at said vent securing device, said casement frame being hinged to said main frame along the top and bottom sides thereof, a manual lock being provided along a side between and adjacent to said top and bottom sides, and said securing device being mounted to said one side which is opposite the side having said manual lock and adjacent to said top and bottom sides.

2. The window of claim 1 wherein said securing device is mounted at generally the central portion of said one side.

3. The window of claim 1 wherein each of said contact surfaces includes a plurality of teeth.

4. The window of claim 3 wherein each of said teeth comprising a steep side extending away from a base and a sloping side extending away from said base and meeting said steep side at the point of its tooth, said base of each tooth lying along a straight base line at an angle to the horizontal, and each steep side being perpendicular to said base line.

5. The window of claim 4 wherein said engaging member includes a tip portion, said abutment member including an extension, and said tip portion contacting said extension when said casement frame is in its closed position.

6. The window of claim 5 wherein said angle of said base line is 45°.

7. In a casement window or the like having a master frame with a casement frame hinged to the master frame, the improvement being a vent securing device for maintaining the window closed along one side thereof when said casement frame is moved to its closed position, said vent securing device comprising an abutment member mounted to said master frame along said one side, said abutment member having a first end disposed and a second end, said first end of said abutment member projecting away from said main frame a greater distance than said second end, a non-planar contacting surface on said abutment member extending from said first end toward said second end, said vent securing device further including an engaging member mounted to said casement frame along said one side, said abutment member being in the pth of motion of said engaging member when said casement framè is moved from its open to its closed positions, said engaging member having a first end disposed toward said first end of said abutment member and a second end disposed toward second end of said abutment member, said second end of said engaging member projecting away from said casement frame a greater distance than said first end, a non-planar contacting surface on said engaging member extending from said first end toward said second end, said contacting surfaces of said abutment member and said engaging member being complementary to each other, said contacting surfaces mating when said casement frame is in its closed position whereby a force urging said casement frame away from said master frame causes said contacting surfaces to remain in mating contact to prevent said casement frame from being moved away from said main frame at said vent securing device, each of said contact surfaces including a plurality of teeth, each of said teeth comprising a steep side extending away from a base and a sloping side extending away from said base and meeting said steep side at the point of its tooth, said base of each tooth lying along a straight base line at an angle to the horizontal, each steep side being perpendicular to said base line, said engaging member including a tip portion, said abutment member including an extension, said tip portion contacting said extension when said casement frame is in its closed position, said angle of said base line being 45°, each of said abutment member and said engaging member being in the form of a flat plate having an inclined boss generally in the central portion of said flat plate, said contacting surface being the inclined surface of said boss, said tip portion of said engaging member being a projection of said engaging member boss, said extension being a portion of said flat plate of said abutment member, said plurality of teeth comprising five teeth on each of said members, and the distance adjacent teeth being about 2.5 times greater than the length of each of said steep sides.

8. The window of claim 1 wherein each of said contact surfaces is a curved cam surface.

9. The window of claim 8 wherein each of said abutment member and said engaging member comprises a flat plate having an inclined boss generally in the central portion of said flat plate, and said cam surface being the inclined surface of said boss.

* * * * *